US009505008B2

(12) United States Patent
Nied et al.

(10) Patent No.: US 9,505,008 B2
(45) Date of Patent: Nov. 29, 2016

(54) METHOD FOR OPERATING AN AGITATOR BEAD MILL AND AGITATOR BEAD MILL THEREFOR

(71) Applicants: NETZSCH Trockenmahltechnik GmbH, Selb (DE); Roland Nied, Bonstetten (DE)

(72) Inventors: Roland Nied, Bonstetten (DE); Hermann Sickel, Gambach/Muenzenberg (DE); Udo Enderle, Marktredwitz (DE)

(73) Assignees: NETZSCH Trockenmahltechnik GmbH, Selb (DE); Roland Nied, Bonstetten (DE)

( * ) Notice: Subject to any disclaimer, the term of this patent is extended or adjusted under 35 U.S.C. 154(b) by 0 days.

(21) Appl. No.: 14/573,882

(22) Filed: Dec. 17, 2014

(65) Prior Publication Data

US 2015/0102139 A1 Apr. 16, 2015

Related U.S. Application Data

(63) Continuation of application No. PCT/DE2013/000360, filed on Jul. 5, 2013.

(30) Foreign Application Priority Data

Jul. 5, 2012 (DE) ..... 10 2012 013 279

(51) Int. Cl.
*B02C 17/00* (2006.01)
*B02C 17/16* (2006.01)
(Continued)

(52) U.S. Cl.
CPC ..... *B02C 17/161* (2013.01); *B02C 17/184* (2013.01); *B02C 17/186* (2013.01); *B02C 17/1835* (2013.01); *B02C 23/20* (2013.01)

(58) Field of Classification Search
CPC . B02C 17/186; B02C 17/1865; B02C 17/00; B02C 17/16; B02C 17/161; B02C 17/183; B02C 17/1835
USPC ..... 241/171, 172, 60, 62
See application file for complete search history.

(56) References Cited

U.S. PATENT DOCUMENTS 1,368,739 A * 2/1921 Lindhard ..... B02C 17/1845 241/171
1,609,299 A * 12/1926 Kennedy ..... B02C 17/18 241/171

(Continued)

FOREIGN PATENT DOCUMENTS

DE 4202101 A1 7/1993
DE 4432200 C1 2/1996

(Continued)

OTHER PUBLICATIONS

International Search Report Application No. PCT/DE2013/000360 Completed: Nov. 13, 2013; Mailing Date: Nov. 25, 2013 2 pages.

*Primary Examiner* — Faye Francis
(74) *Attorney, Agent, or Firm* — Whitmyer IP Group LLC

(57) ABSTRACT

A method for dry operation of an agitator bead mill, with a mill housing that includes a grinding chamber, in which a rotatable agitator shaft extends horizontally between an input side and an output side and in which grinding media are situated. An output gas is fed into the grinding chamber on the output side, goes together with ground grist through the separation system radially with respect to the transport direction, and thus leaves the grinding chamber together with ground grist through the separation system and onward through the product output. Also disclosed is an agitator bead mill for executing the method, such that the separation system has a static sieve with a free perforated surface that is chosen in such a way that the pass-through speed of the gas leaving the agitator mill through the separation system and the product outlet amounts approximately to 10 m/s to 30 m/s.

13 Claims, 2 Drawing Sheets

(51) Int. Cl.

| | |
|---|---|
| ***B02C 17/18*** | (2006.01) |
| ***B02C 23/20*** | (2006.01) |

(56) References Cited

U.S. PATENT DOCUMENTS

| | | | | |
|---|---|---|---|---|
| 2,595,117 | A | 4/1952 | Ahlmann | |
| 4,369,926 | A * | 1/1983 | Rasmussen | B02C 17/06 241/153 |
| 4,511,092 | A * | 4/1985 | North | B02C 19/16 241/153 |
| 4,739,938 | A * | 4/1988 | Ishikawa | B02C 17/16 241/171 |
| 5,183,215 | A * | 2/1993 | Getzmann | B02C 17/16 241/171 |
| 5,251,826 | A * | 10/1993 | Schonbach | B02C 17/183 241/152.2 |
| 5,873,532 | A * | 2/1999 | Fontanille | B02C 17/1845 241/171 |
| 5,967,432 | A | 10/1999 | Chen | |
| 6,547,171 | B1 * | 4/2003 | Fontanille | B02C 17/1875 241/171 |
| 6,827,303 | B2 * | 12/2004 | Yanase | B02C 17/06 241/57 |
| 8,118,247 | B2 * | 2/2012 | Lang | B02C 17/16 241/171 |
| 8,702,023 | B2 * | 4/2014 | Enderle | B02C 17/161 241/171 |
| 2003/0226920 | A1 * | 12/2003 | Yanase | B02C 17/06 241/171 |
| 2010/0127108 | A1 | 5/2010 | Harbs | |
| 2011/0000993 | A1 * | 1/2011 | Lang | B02C 17/16 241/171 |

FOREIGN PATENT DOCUMENTS

| | | | |
|---|---|---|---|
| DE | 19830960 | A1 | 1/2000 |
| DE | 10064828 | A1 | 6/2002 |
| DE | 102007054885 | A1 | 5/2009 |
| EP | 2189221 | A2 | 5/2010 |
| JP | 08131860 | A | 5/1996 |
| JP | 2009119317 | A | 6/2009 |
| JP | 2010517739 | A | 5/2010 |
| WO | 2010112274 | A1 | 10/2010 |
| WO | 2012055388 | A2 | 5/2012 |

* cited by examiner

METHOD FOR OPERATING AN AGITATOR BEAD MILL AND AGITATOR BEAD MILL THEREFOR

FIELD OF THE INVENTION

The present invention relates generally to a method for operating an agitator bead mill and, more particularly, to one that encloses a grinding chamber, in which a rotatable agitator shaft extends horizontally between an input side and an output side and in which grinding media are situated, and to an agitator bead mill for executing this method.

BACKGROUND OF THE INVENTION

Agitator bead mills, also referred to as attritors, are known with a vertically or horizontally disposed agitator shaft.

In wet operation of corresponding agitator bead mills known in the art, a flowable grist suspension is conveyed, in particular continuously by means of a pump, in a housing of the agitator bead mill, from a product inlet on the input side of a grinding chamber, to a product outlet on the output side of the grinding chamber.

The agitator shaft of a grinding or agitator apparatus, which can also contain agitating elements such as rods or disks or can be simply a smooth-walled agitator body, feeds energy into a grinder media filling (not shown) in the grinding chamber. The impacting and thus the breakdown of the grist occurs at the contact points of the grinding media moved by rotation of the agitator shaft, in particular by impact and shearing forces. A solid content of 30% to 60% is customary in the suspension. This corresponds to a load of 300 kg to 600 kg of grist per $m^3$ of liquid, such as water in particular.

Before the product emerges, a separation system, consisting in particular of a rotating outer basket and a static cylindrical sieve, is disposed in its interior. Separation of grinding media remaining in the mill and of the suspension with milled grist that thus leaves the bead mill occurs in the separation system.

In principle, a mill of this type can also be operated dry, as is familiar in the art. In order to ensure similar conditions in the grinding chamber, especially with respect to particle concentration, however, only a very low gas volume stream (as opposed to liquid, in wet operation) can be applied with the grist, said stream not being sufficient in itself for product transport from the product input all the way through the product output. The cause is the lower density of gases, by about a factor of 1,000 in comparison with liquids.

In the grinding chamber itself, this usually causes no problems since the movement of the agitator shaft and grinding media also "carries along" the grist. What is problematic, on the other hand, is the product conveyance in the area of the separation system. At this site, there can be sticking and crust of the grist. These stickings and crust grow "from behind" into the grinding chamber. There is a breakdown in the removal of grist and thus the flow rate of the agitator bead mill that remained dry. This results, finally, in the disadvantage that continuous operation is then no longer possible.

As general background technology, an agitator mill, according to DE 44 32 200 C1, includes a mill container that encloses a grinding chamber, an agitator apparatus rotatably disposed in it concentrically to the center longitudinal axis of the mill container, a power motor coupled with the agitator apparatus, a line diverting grist and grinding media out of the grinding chamber, a device for separation of grist and auxiliary grinding auxiliary media that is connected with the output line and separated from the agitator mill, a grist feeder and auxiliary grinding medium recirculating line connected with the separation device and a grist feeder line on the one hand and with the grinding chamber on the other hand, and a grist pump into the grist feeder line. Here the separation device comprises a housing in which a rotor is disposed that can be rotary-powered independently of the power drive of the agitator and can advance the auxiliary grinding media centrifugally from the grist and into the line that feeds the grist and circulates the auxiliary grinding media. The mill container, the output line for grist and auxiliary grinding media, the separation device and the line feeding the grist and circulating the grinding auxiliary media form a closed system. Only the grist pump disposed in the grist feeder line serves as a device to convey grist and grinding auxiliary media in the line feeding grist and circulating auxiliary grinding media.

Similarly, patent WO 2012/055388 A2 discloses as general prior art an agitator bead mill for grinding dry or non-dry substances, with a mill container that is filled at least partly with auxiliary grinding media, an inlet and an outlet for the grindable material or grist, a sieve disposed in an outlet area, an agitator shaft running through the center of the mill container, and several grinder elements disposed on the agitator shaft. Here, a first cage is linked to an inlet area and a second cage to the outlet area. A fluid inlet is linked to the inlet area. A cleaning apparatus is disposed in the center of the sieve.

Patent DE 10 2007 054 885 A1 relates to a method for fractioning of a dispersion of oxidic nanoparticles. Here a wet grinding process is described, which uses a membrane crosswise flow filtration, such that overflowing of the membrane is generated with dispersion by power-driven rotating parts.

U.S. Pat. No. 5,967,432 A relates to fully explicitly straight mills, which do not work with beads as grinding media and in which, instead, the material is crushed by collision and friction within itself and with respect to the inner surface of the grinding chamber. Technical features in connection with the use of grinding media basically cannot be taken from this publication.

Patent 2 595 117 A discloses a method for grinding in a vertical mill with grinding media with a continual removal of grinding media and grist at the upper end and an external separation apparatus. In the separation apparatus, "over-size material fractions" and grinding media are selected out by an upwardly flowing air stream in order to be fed back into the mill.

From patent DE 42 02 101 A1, a method for treating dry to damp material is known, such that the material is conveyed onward by a transported assortment of grinding media by gravitational action. Material conveyed by the aggregate of grinding media undergoes comminution, for example, during its passage. A fluid is added to this fractioned material shortly before its exit from the aggregate or comminution process and is mixed with it. With respect to the apparatus, this publication discloses a vertical grinding mill with a cylindrical, vertical-axis mill container inside which an agitator screw and grinding media are situated. A material intake is disposed in the upper area of the mill container and a material removal in the base. Closely above the material removal, nozzles are disposed radially in the wall of the mill container and inclined in the direction toward the material removal. The axes of the nozzles intersect with the axis of the mill container. Shortly before and/or during the product removal, a fluid is to be added by means of the nozzles. They serve to keep the motion of the fluid in the direction of the material transport. Contrary thereto, our method causes the fluid to move in a direction diverted away from the transport direction of the grist.

SUMMARY OF THE INVENTION

The present invention has and achieves the object of improving dry operation of agitator bead mills and in particular of at least substantially preventing stickings and crust of grist at the separation system, or in other words a blockage of the separation system, before the product exits.

This object is achieved with a method for operating an agitator mill that encloses a grinding chamber, in which a rotatable agitator shaft extends horizontally between an input side and an output side and in which grinding media are situated.

Disclosed is a method for dry operation of an agitator bead mill, with a mill housing that encloses a grinding chamber, in which a rotatable agitator shaft runs horizontally between an input side and an output side and in which grinding media are situated, such that

- on the input side, grist to be milled is fed into the grinding chamber through a product inlet,
- the grist that is to be milled is transported from the input side along the agitator shaft in a transport direction parallel to the axial direction of the agitator shaft to the output side and thereby is ground by the grinding media,
- ground grist exits from the grinding chamber on the output side, by going radially with respect to the transport direction through a separation system that detains the grinding media, and
- the ground grist then leaves the agitator bead mill through a product outlet situated downstream from the separation system,
- is characterized in that an output gas is fed into the grinding chamber on the output side in the area of the separation system, goes, together with ground grist, through the separation system radially with respect to the transport direction, and thus leaves the grinding chamber together with ground grist through the separation system and then through the product output.

This means that the output gas is thus introduced directly in the area ahead of the separation system. The output gas causes, on the one hand, an acceleration of the ground grist to the separation system in this area, so that a depositing of ground grist on the surface of the separation system is prevented or at least reduced, and on the other hand, the blowing-off of the surface of the separation system, whereby small amounts of ground grist left there are blown away. Blockage of the separation system is thereby effectively prevented.

It is, moreover, particularly preferred that the output gas is introduced into the grinding chamber on the output side in the area of the separation system in a direction diverging from the transport direction.

An additional preferable configuration foresees that, in addition to the grist that is to be ground, a gas volume stream is introduced into the grinding chamber on the input side of the agitator mill, and that the gas volume stream contributes toward transporting the grist that is to be ground, that the gas volume stream amounts to only 5% to 20%, preferably 5% to 10%, of the total gas quantity that leaves the agitator mill through the separation system and the product outlet, and that the supply of output gas is selected in such a way that the load of the entire gas leaving the agitator mill through the separation system and the product outlet with ejected grist amounts to approximately 0.3 $kg/m^3$ to 0.7 $kg/m^3$.

It can further be foreseen preferably that the load of the entire gas leaving the agitator mill through the separation system and the product outlet with ejected grist amounts to about 0.4 $kg/m^3$ to 0.6 $kg/m^3$.

It is further preferred that an air classifier is charged in line with the gas-grist mixture that leaves the agitator mill through the separation system and the product outlet.

In addition, the invention provides an agitator bead mill for executing the method just described, such that the separation system has a static sieve with a free perforated surface that is chosen in such a way that the pass-through speed of the gas leaving the agitator mill through the separation system and the product outlet amounts to approximately 10 m/s to 30 m/s, preferably 15 m/s to 25 m/s.

Preferably there is present on the output side a mill base, which comprises output gas entrance boreholes for entrance of the output gas into the grinding chamber, and the said entrance gas input boreholes are covered with a sieve.

It is further preferred that the output gas entrance boreholes for admitting output gas into the grinding chamber are disposed and/or oriented in such a way that output gas is introduced into the grinding chamber at least partly, preferably substantially, contrary to the transport direction.

In an additional preferable configuration, the output gas input boreholes are supplied with a common output gas intake pipe through a spiral-shaped output gas distributor housing.

Additional preferred and/or advantageous configurations of the invention and of its individual aspects can be seen from combinations disclosed herein as well as from the entire present application documents.

The invention is explained in greater detail, merely in exemplary manner, with reference to the drawings, which are as follows.

DETAILED DESCRIPTION OF THE INVENTION

Figure 1:
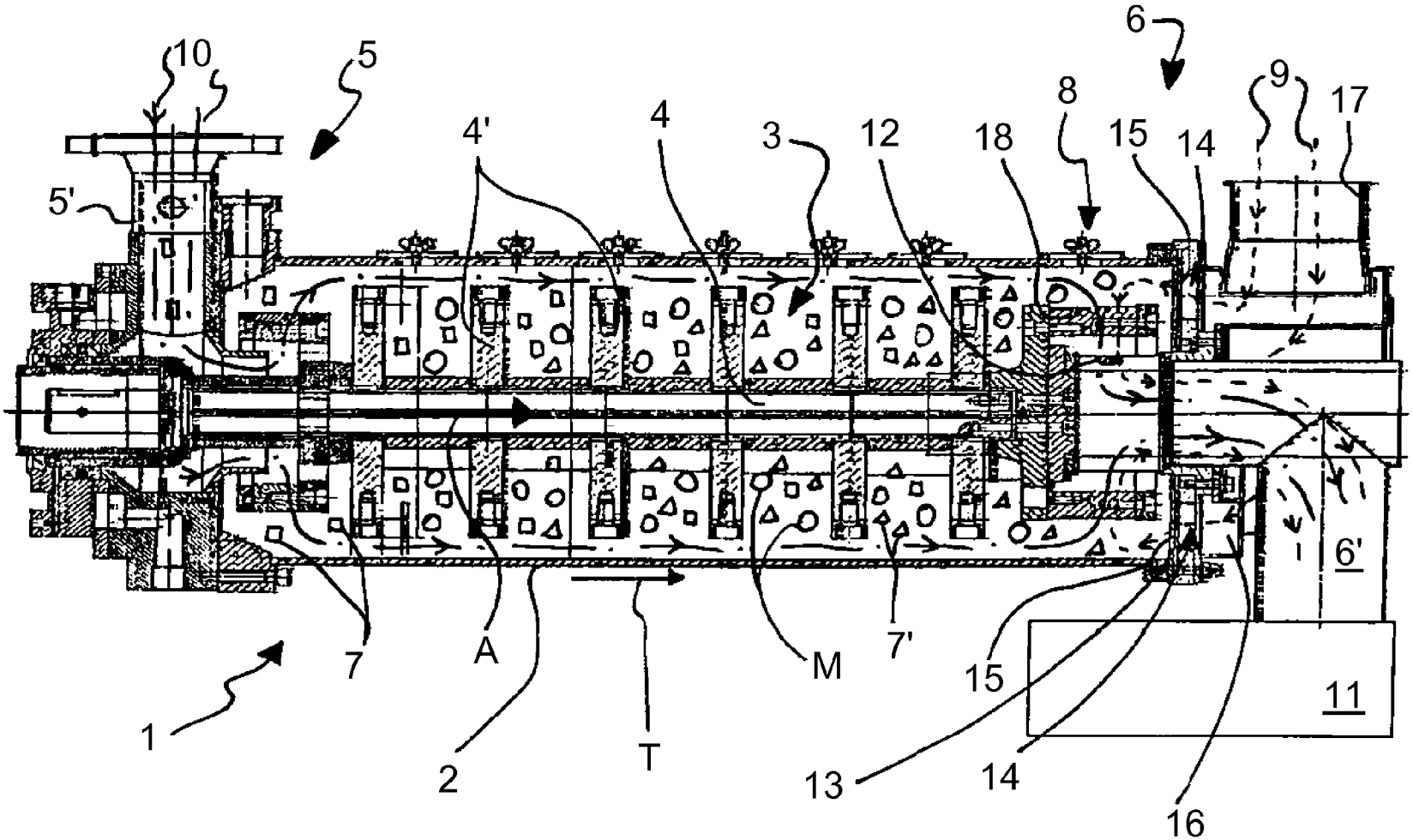
FIG. 1 illustrates, in a schematic sectional view, an embodiment of an agitator bead mill.

On the basis of the embodiments and application examples described hereinafter and illustrated in the drawings, the invention is described in greater detail, merely by way of example; that is, it is not restricted to these embodiments and application examples. Features of the method and apparatus can be seen in each case analogously from apparatus or method descriptions.

Individual features that are indicated and/or depicted in connection with a concrete embodiment are not restricted to the aforesaid embodiment or the combination with the other features of said embodiment, but instead can be combined with any other variants at all in the context of what is technically possible, even when they are not separately treated in the present documents.

Identical reference numbers in the individual figures and illustrations designate identical or similar, or identically or similarly acting, components. In addition, by means of the depictions in the drawings, other features are made clear that are not provided with reference numbers, independently of whether such features are described thereafter or not. On the other hand, features that are contained in the present description but are not visible or illustrated in the drawings are readily understandable to a person skilled in the art.

Figure 2:
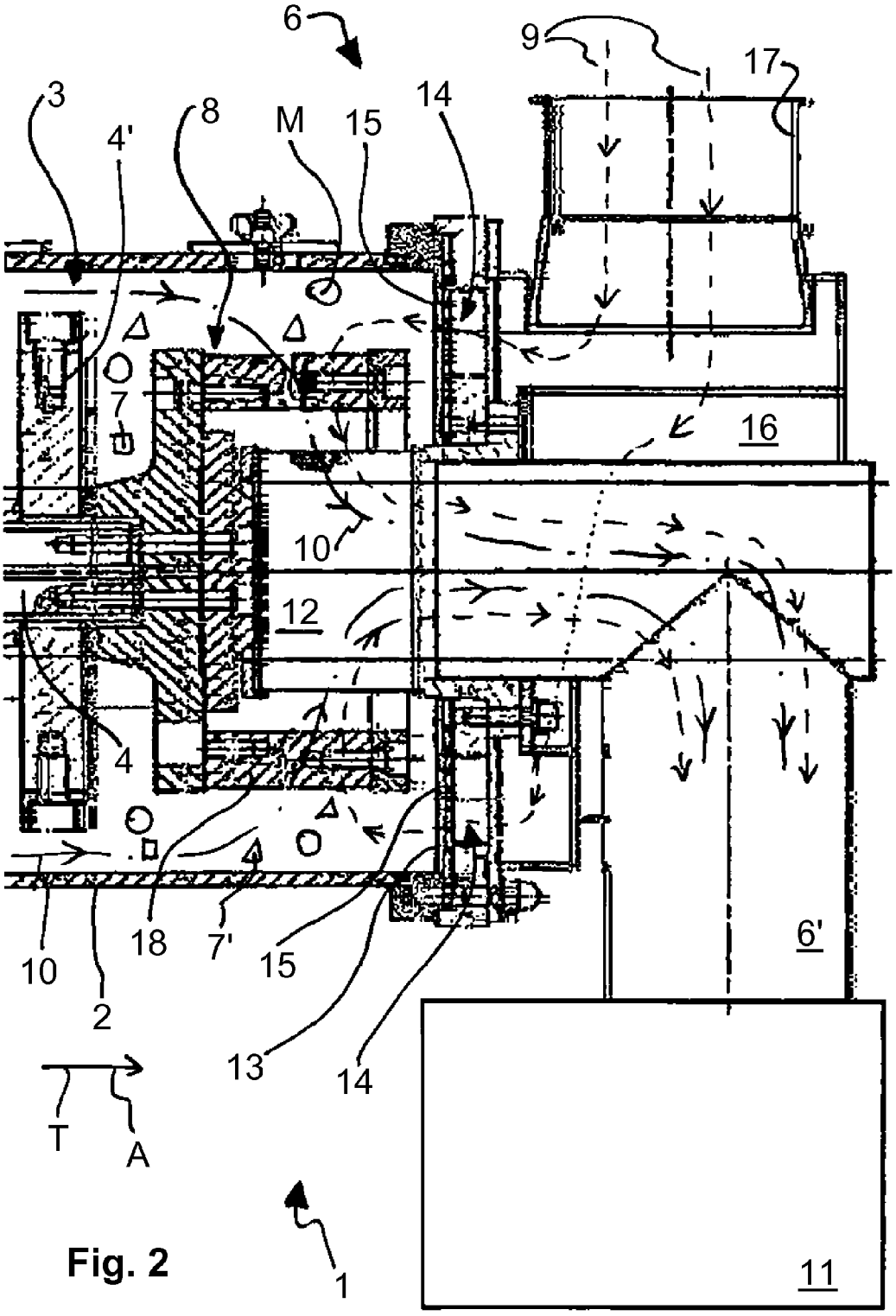
FIG. 2 clarifies further details, in a schematic enlarged partial sectional view of the agitator bead mill from FIG. 1.

FIGS. 1 and 2 show by way of example an agitator bead mill 1 adapted for dry operation, laid out in longitudinal section and as an enlarged part thereof, respectively. The agitator bead mill 1 contains a mill housing 2, which encloses a grinding chamber 3 that is, in particular, cylindrical in shape. An agitator shaft 4 is rotatably disposed in the grinding chamber 3 horizontally between an input side 5 and an output side 6 of the mill housing 2. Also situated in the grinding chamber 3 are grinding media M, which consist for the most part of steel, glass or wear-resistant ceramic materials, to which the present invention is, however, not restricted and of which only a few are shown by way of example in FIG. 1 for the sake of clarity.

The agitator shaft 4 rotating in the grinding chamber 3 during operation of the agitator bead mill 1 is a component, in general, of a grinding or agitator apparatus that is generally known and can also contain agitator elements 4', such as rods or disks for example, or can be just a smooth-walled agitator body. No further details will be provided here on grinding or agitator apparatuses, because the present invention is independent of any or all corresponding structures. Energy is introduced into the grinding media filling in the grinding chamber 3 by rotation of the agitator shaft 4. Usually, but not restrictively, the free volume of the grinding chamber 3 not taken up by the grinding or agitator apparatus is, for example, 70% to 90% filled with grinding media M.

Situated on the input side 5 is a product inlet 5', through which the grist 7 that is to be ground is fed into the grinding chamber 3. Grist 7 to be ground is symbolized in FIG. 1 by small squares, which are indicated byway of example only in some places in order to maintain clarity of the visual illustration.

In addition to the grist 7 that is to be ground, on the input side 5 of the agitator mill 1 a small gas volume stream 10 is introduced into the grinding chamber 3 (as shown in FIGS. 1 and 2 by arrows with dot-and-dash lines), which contributes toward transporting the grist 7 that is to be ground in a transport direction T parallel to the axial direction A of the agitator shaft 4, but which in itself is not sufficient. Primarily by the agitator shaft 4 rotating during operation of the agitator bead mill 1, the grist 7 that is to be ground is transported from the input side 5 along the agitator shaft 4 in the transport direction T parallel to the axial direction A of the agitator shaft 4 to the output side 6 and thereby is ground by the grinding media M.

Ground grist 7' then exits on the output side 6 from the grinding chamber 3, radially with respect to the transport direction T, going through a separation system 8, which detains the grinding media M, that is, keeps them back in the grinding chamber 3. Then the ground grist 7' leaves the agitator bead mill 1 through a product outlet 6' situated downstream from the separation system 8. Ground grist 7' is symbolized in FIGS. 1 and 2 by small triangles, which are indicated only in places, by way of example, in order to maintain clarity of the illustration.

The separation system 8, in customary manner, contains a basket 18 that rotates together with the agitator shaft and that essentially holds back the grinding media M in the grinding chamber 3, and a cylindrical static sieve 12 disposed inside the basket 18, as further barrier. At this static sieve, the stickings or crusts of grist occur as is customary in dry-operating agitator bead mills known in the art, whereby this static sieve becomes obstructed, which in turn disturbs or even prevents operation of such an agitator bead mill. If such stickings and crusts, in addition, grow "from behind" into the grinding chamber, the intermediate space between the rotating basket and the static sieve becomes overgrown, which results in additional operational disturbances in such agitator bead mills. Owing to these disadvantages, continuous operation is thus no longer possible.

To counteract these disadvantages, in addition, there is situated in the agitator bead mill 1 on the output side 6 a mill base 13 that closes the mill housing 2 and that comprises output gas entrance boreholes 14 for entrance of output gas 9 (illustrated in FIGS. 1 and 2 with arrows with closely broken lines) into the grinding chamber 3, details of which can be clearly recognized in the enlarged drawing in FIG. 2.

These output gas entrance boreholes 14 are covered by a sieve 15, such as for example a slotted sieve. In addition, the output gas entrance boreholes 14 are disposed and/or aligned for the entry of the output gas 9 into the grinding chamber 3 in such a way that the output gas 9 streams into the grinding chamber 3 at least partly, preferably substantially, counter to the transport direction T. To feed the output gas entrance boreholes 14 with output gas 9, a spiral-shaped output gas distributor housing 16 is provided that encircles the product outlet 6'. The output gas distributor housing 16 is connected with an output gas intake pipe 17, so that all output gas entrance boreholes 14 are jointly fed by one output gas source (not shown).

During operation of the agitator bead mill 1, the output gas 9 is introduced into the grinding chamber 3 on the output side 6 in the area of the separation system 8. The result is that the output gas 9 together with the gas volume stream 10 and the ground grist 7' passes through the separation system radially with respect to the transport direction T or perpendicular to it and so that the output gas 9, the gas volume stream 10 and the ground grist 7' leave the grinding chamber 3 through the separation system 8 and then through the product outlet 6'.

As a result of the arrangement and orientation of the output gas entrance boreholes 14, the output gas 9 is directed into the grinding chamber 3 on the output side 6 in the area of the separation system 8 in a direction that diverges from the transport direction T. The processes in the grinding chamber 3, that is, the transporting of the grist 7 that is to be ground along the agitator shaft 4 in the direction from the input side 5 to the output side 6 and the grinding operation as such, are not influenced by the in-streaming output gas 9, because the output gas 9 does not reach these areas of the grinding chamber 3 but instead streams into the separation system 8 corresponding to the general transport direction of the grist 7, 7'.

It is to be noted that the gas volume stream 10, as indicated above, is kept small and constitutes only 5% to 20%, preferably only 5% to 10%, of the entire gas quantity that leaves the agitator mill 1 through the separation system 8 and the product outlet 6'. In other words, in the present embodiment the portion of the output gas 9 in relation to the entire gas quantity that leaves the agitator mill 1 through the separation system 8 and the product outlet 6' is at least 80%, preferably at least 90%, and at most 95%.

The input of output gas 9 here is selected in such a way that the load of the entire gas that leaves the agitator mill 1 through the separation system 8 and the product outlet 6' with removed grist 7' amounts to approximately 0.3 $kg/m^3$ to 0.7 $kg/m^3$, preferably approximately 0.4 $kg/m^3$ to 0.6 $kg/m^3$.

The static sieve 12 of the separation system 8, in addition, is configured preferably in such a way that it has a free perforated surface, which is chosen in such a way that the pass-through speed of the gas (volume stream) leaving the agitator mill 1 through the separation system 8 and the product outlet 6' is approximately 10 m/s to 30 m/s, preferably 15 m/s to 25 m/s. This pass-through speed or streaming speed is defined as follows:

Pass-through speed=Volume stream/free perforated surface

With the output gas 9, the ground grist 7' is, so to speak, brought up to a higher speed immediately before the separation system 8, so that it can easily pass through the rotating basket 18 and especially the static sieve 12 and does not get caught on the corresponding surfaces, as was explained above. Said volume stream can generally be chosen in such a way that the product is transported safely out of the grinding chamber 3 through the separation system 8 to the outside. The rotating basket 18 and especially the static sieve 12 remain unobstructed and do not impede continuous operation of the agitator bead mill 1.

Even though an earlier section described feeding the output gas 9 against the transport or conveyor direction T of the grist 7 along the agitator shaft 4, this was not intended as restrictive. The in-streaming direction of the output gas 9 through output gas entrance boreholes 14 into the grinding chamber 3 is preferably such that this in-streaming direction forms an angle of >0° to the aforementioned transport direction T, in particular an angle between 90° and 180°. In other words, it is preferable that the output gas 9 is not fed along the agitator shaft 4 in the transport or conveyor direction T of the grist 7.

The agitator bead mill 1, still according to the embodiment shown in FIG. 1, can include an air classifier 11, which is charged in line with the gas-grist mixture that is leaving the agitator bead mill 1 through the separation system 8 and the product outlet 6'.

The invention is depicted merely by way of example, with reference to the embodiments in the description and in the drawings, and is not restricted to them but rather includes the variations, modifications, substitutions and combinations which a person skilled in the art can understand from the present documents, particularly in the context of the claims and the general depictions in the introduction to this description and in descriptions of the embodiments, and can combine with his/her specialized knowledge and with the prior art. In particular, all individual features and configuration possibilities of the invention can be combined.

REFERENCE LIST

1 Agitator bead mill
2 Mill housing
3 Grinding chamber
4 Agitator shaft
4' Agitator elements
5 Input side
5' Product inlet
6 Output side
6' Product outlet
7 Grist to be ground
7' Ground grist
8 Separation system
9 Output gas
10 Gas volume stream
11 Air separator
12 Static sieve
13 Mill base
14 Output gas input boreholes
15 Sieve
16 Spiral-shaped output gas distributor housing
17 Output gas intake pipe
18 Basket
A Axial direction
M Grinding medium
T Transport direction

What is claimed is:

1. A method for dry operation of an agitator bead mill, with a mill housing that encloses a grinding chamber, in which a rotatable agitator shaft extends horizontally between an input side and an output side and in which grinding media are situated, said method including the steps of:

on the input side, feeding grist that is to be ground into the grinding chamber through a product inlet, transporting the grist that is to be ground from the input side along the agitator shaft in a transport direction parallel to the axial direction of the agitator shaft to the output side and thereby grinding it by the grinding media, the ground grist exiting from the grinding chamber on the output side, by going radially with respect to the transport direction through a separation system that detains the grinding media, the ground grist then leaving the agitator bead mill through a product outlet situated downstream from the separation system, and feeding an output gas into the grinding chamber on the output side in the area of the separation system and at least partly against the transport direction, said output gas going, together with ground grist, through the separation system radially with respect to the transport direction, and thus said output gas leaving the grinding chamber together with ground grist through the separation system and onward through the product output.

2. The method according to claim 1, wherein the output gas is directed into the grinding chamber on the output side in the area of the separation system in a direction diverging from the transport direction.

3. The method according to claim 2, wherein, in addition to the grist that is to be ground, a gas volume stream is introduced into the grinding chamber on the input side of the agitator mill, and said gas volume stream contributes toward transporting the grist that is to be ground, wherein the gas volume stream constitutes only 5% to 20% of the total gas quantity that leaves the agitator mill through the separation system and the product outlet, and wherein the feeding of output gas is chosen in such a way that the load of the entire gas leaving the agitator mill through the separation system and the product outlet with removed grist amounts to approximately 0.3 $kg/m^3$ to 0.7 $kg/m^3$.

4. The method according to claim 1, wherein, in addition to the grist that is to be ground, a gas volume stream is introduced into the grinding chamber on the input side of the agitator mill, and said gas volume stream contributes toward transporting the grist that is to be ground, wherein the gas volume stream constitutes only 5% to 20%, of the total gas quantity that leaves the agitator mill through the separation system and the product outlet, and wherein the feeding of output gas is chosen in such a way that the load of the entire gas leaving the agitator mill through the separation system and the product outlet with removed grist amounts to approximately 0.3 $kg/m^3$ to 0.7 $kg/m^3$.

5. The method according to claim 4, wherein the load of the entire gas leaving the agitator mill through the separation system and the product outlet with removed grist amounts to approximately 0.4 $kg/m^3$ to 0.6 $kg/m^3$.

6. The method according to claim 1, wherein an air classifier is activated in line with the gas-grist mixture leaving the agitator mill through the separation system and the product outlet.

7. The method according to claim 1, wherein output gas inlet boreholes are disposed and/or aligned in such a way that output gas is directed at an angle between 90° and 180° with respect to the transport direction.

8. An agitator bead mill for executing a method for dry operation of an agitator bead mill, with a mill housing that encloses a grinding chamber, in which a rotatable agitator shaft ex-tends horizontally between an input side and an output side and in which grinding media are situated, such that on the input side, grist that is to be ground is fed into the grinding chamber through a product inlet, the grist that is to be ground is transported from the input side along the agitator shaft in a transport direction parallel to the axial direction of the agitator shaft to the output side and thereby is ground by the grinding media, ground grist exits from the grinding chamber on the output side, by going radially with respect to the transport direction through a separation system that detains the grinding media, and the ground grist then leaves the agitator bead mill through a product outlet situated downstream from the separation system, wherein an output gas is fed into the grinding chamber on the output side in the area of the separation system, goes, together with ground grist, through the separation system radially with respect to the transport direction, and thus leaves the grinding chamber together with ground grist through the separation system and onward through the product output, wherein the separation system has a static sieve with a free perforated surface, which is chosen in such a way that the pass-through speed of the gas leaving the agitator mill through the separation system and the product outlet amounts to 10 m/s to 30 m/s.

9. The agitator bead mill according to claim 8, wherein on the output side a mill base is present that comprises output gas input boreholes to admit the output gas into the grinding chamber and wherein said output gas input boreholes are covered by a sieve.

10. The agitator bead mill according to claim 9, wherein the output gas inlet boreholes to admit the output gas into the grinding chamber are disposed and/or aligned in such a way that output gas is directed into the grinding chamber at least partly against the transport direction.

11. The agitator bead mill according to claim 10, wherein the output gas inlet boreholes are equipped with a common output gas intake pipe through a spiral-shaped output gas distributor housing.

12. The agitator bead mill according to claim 10, wherein the output gas inlet boreholes are disposed and/or aligned in such a way that output gas is directed at an angle between 90° and 180° with respect to the transport direction.

13. The agitator bead mill according to claim 9, wherein the output gas inlet boreholes are equipped with a common output gas intake pipe through a spiral-shaped output gas distributor housing.

* * * * *